United States Patent [19]

Drueck, Jr.

[11] 4,290,218

[45] Sep. 22, 1981

[54] CEILING MODULE

[76] Inventor: Fred Drueck, Jr., 4941 W. Henderson, Chicago, Ill. 60641

[21] Appl. No.: 160,958

[22] Filed: Jun. 19, 1980

[51] Int. Cl.[3] ..... G09F 13/00

[52] U.S. Cl. ..... 40/553; 362/150; 362/396; 40/612

[58] Field of Search ..... 40/611, 453, 612, 616, 40/559, 553; 362/150, 396

[56] References Cited

U.S. PATENT DOCUMENTS

| | | | |
|---|---|---|---|
| 354,621 | 12/1886 | Belknap | 40/453 |
| 385,912 | 7/1888 | Coote | 40/453 |
| 3,575,773 | 4/1971 | Courtot | 40/453 |
| 4,075,775 | 2/1978 | Shorette | 40/559 |

*Primary Examiner*—Gene Mancene
*Assistant Examiner*—Wenceslao J. Contreras
*Attorney, Agent, or Firm*—Jakala, Knechtel, Valentino, Demeur & Dallas

[57] ABSTRACT

A three dimensional internally illuminated advertising device is sized the same as the panels forming a suspended ceiling and is used in place of one of the panels and is supported by the suspended ceiling grid network.

4 Claims, 10 Drawing Figures

CEILING MODULE

BACKGROUND OF THE INVENTION

This invention relates to a panel module for use with suspended ceilings having spaced apart grid members defining panel receiving areas and, more particularly, to such panel modules which are or can be provided with indicia for advertising or the like and which can be removably substituted for any one of the ceiling panels normally removably supported by the grid members.

Suspended ceilings formed of spaced apart grid members which removably support ceiling panels and/or lighting fixtures disposed in cooperative working relationship with predetermined ones of the ceiling panels presently are well known and used extensively, particularly in supermarkets, retail stores and the like. The material from which the ceiling panels are fabricated and the grid members have, in the past, been utilized to support various types of advertising materials which are affixed to the ceiling panels and/or the grid members. The advertising material normally is suspended by means of string or wire, or supported to hang some distance below the ceiling, by means of, for example, string, wire or the like. While such methods of displaying advertising are widely used and accepted, it often detracts from the decor of the store and, in extreme cases, presents a rather cluttered appearance.

The panel module of the present invention, in its broadest aspect, can be utilized in combination with a suspended ceiling as a ceiling panel to provide a decorative or ornate ceiling appearance. However, the panel module is particularly unique in its application as an advertising display panel module for use with such suspended ceilings, in that it provides a plurality of side walls and/or surface areas upon which advertising indicia can be placed. The advertising display panel module can be removably substituted for any one of the ceiling panels, so that they may be strategically substituted for the ceiling panels at any location within the ceiling. More particularly still, the advertising display panel modules can be utilized in combination with the lighting fixtures normally provided in such suspended ceilings or, alternatively, can themselves be provided with lighting means, so that a lighted advertising display panel module is provided.

In accordance with the present invention, the panel module comprises a hollow enclosure formed by a plurality of walls, at least some of which depend downwardly with respect to the suspended ceiling and provides surfaces for receiving thereon advertising indicia or the like. The panel modules are supported by the grid members which normally support the ceiling panels and define the respective ones of the panel receiving areas, and are co-extensive in area with the respective ones of the panel receiving areas. One or more of the panel modules therefore can be removably disposed in conjunction with or in substitution for any one of the ceiling panels to provide readily visible advertising, at any desired location. The hollow enclosure formed by the plurality of walls can assume any one of a number of different shapes, and can therefore provide various different surfaces for receiving the indicia.

Accordingly, it is an object of the present invention to provide a new and improved panel module for use with suspended ceilings and, in particular, an advertising display panel module for use with suspended ceilings.

BRIEF DESCRIPTION OF THE DRAWINGS

Referring now to the drawings.

DESCRIPTION OF THE INVENTION

Figure 1:
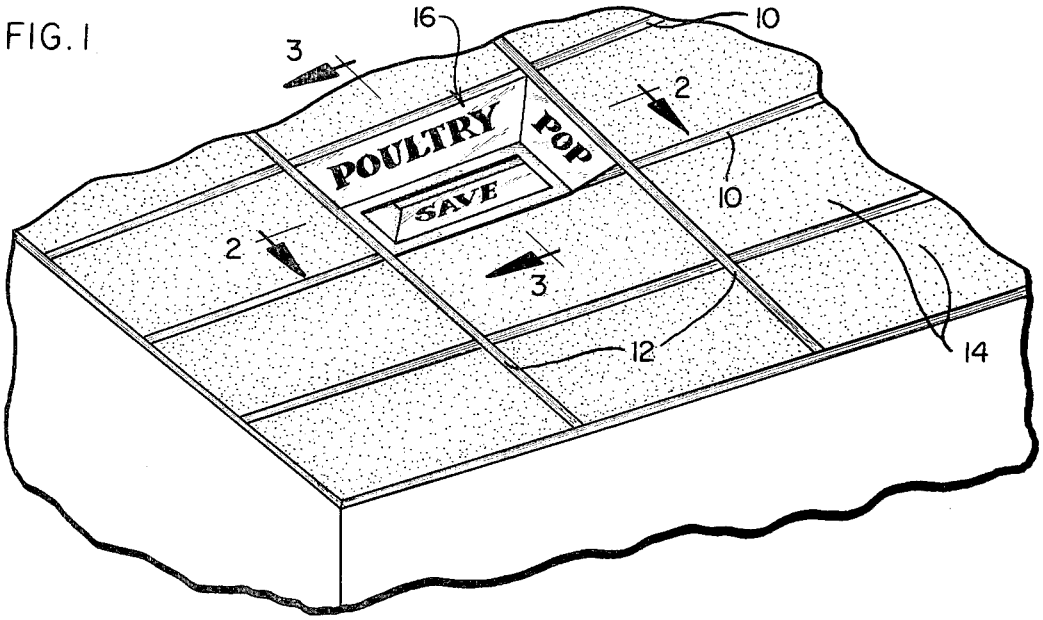
FIG. 1 is a partial isometric view of a suspended ceiling, illustrating a panel module exemplary of the present invention used in combination therewith.

Referring now to the drawings, in FIG. 1 there is generally represented a suspended ceiling of a typical construction including a plurality of longitudinal and transverse grid members 10 and 12 which are mounted in spaced apart relationship defining a plurality of panel receiving areas in which ceiling panels 14 normally are removably disposed. In many instances, at various locations, lighting fixtures are installed in operative relationship with one of the panel receiving areas defined by the grid members 10 and 12. In such cases, the ceiling panel is replaced with a translucent lighting panel or the like, to provide a source of light. In FIG. 1, an advertising display panel module 16 exemplary of a first embodiment of the invention is illustrated as it is removably supported by the longitudinal and transverse grid members 10 and 12, in substitution for one of the ceiling panels 14.

Figure 2:
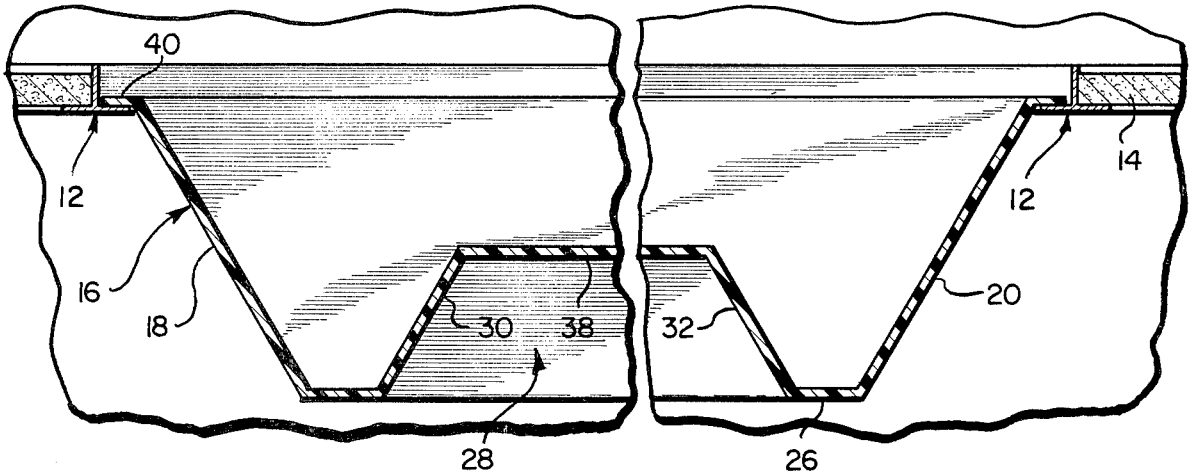
FIG. 2 is a sectional view taken along lines 2—2 of FIG. 1.
Figure 3:
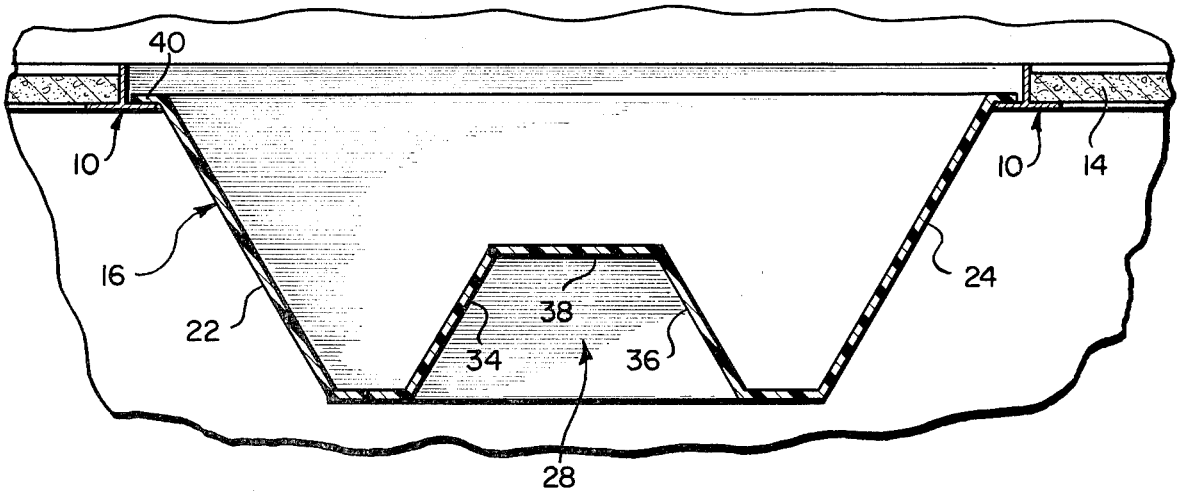
FIG. 3 is a sectional view taken along lines 3—3 of FIG. 1.

The advertising display panel module 16, as can be best seen in FIGS. 1–3, in accordance with this embodiment of the invention, is generally of a truncated pyramidal shape or construction having a base which is proportioned to be co-extensive in area to the panel receiving areas defined by the longitudinal and transverse grid members 10 and 12. More particularly, the advertising display module 16 has a horizontally extending peripheral rim 40 which is proportioned to seat on the horizontal leg member of the T-shaped longitudinal and transverse grid members 10 and 12, to removably support the advertising display panel module 16 in a suspended position from the grid members 10 and 12. The advertising display module 16 has side walls 18 and 20 and end walls 22 and 24 integrally formed with the peripheral rim 40, and a bottom wall 26. In the illustrated embodiment, the advertising display panel module 16 also has formed in its bottom wall 26 a truncated pyramidal shaped recessed cavity 28 having side walls 30 and 32, end walls 34 and 36 and a bottom wall 38. It may be noted that the side walls 18 and 20 and the end walls 22 and 24 preferably and advantageously are of a substantial width so that these walls depend a substantial distance below the height of the suspended ceiling and provide relatively large surfaces for receiving thereon indicia, such as advertising indicia. These side and end walls also are angularly disposed, thus permitting the indicia provided on them to be more readily and easily visibly observed. Correspondingly, the side walls 30 and 32 and end walls 34 and 36, while of smaller dimensions, likewise provide a plurality of surfaces for receiving thereon indicia for advertising purposes or the like.

The advertising display panel modules 16 may be formed of various types of material such as wood, metal, corrugated paperboard, cardboard and various plastics. Preferably and advantageously, however, the advertising display modules 16 are relatively light in weight and, in this respect, advantageously are of a plastic material which can be vacuum formed to provide a lightweight, hollow enclosure. Correspondingly, the advertising display modules can be molded of an expanded polystyrene, or injection molded. The indicia can be provided on the advertising display module 16 in any suitable fashion or, alternatively, can be provided on inserts which are removably affixed to its walls as described more fully below.

Figure 4:
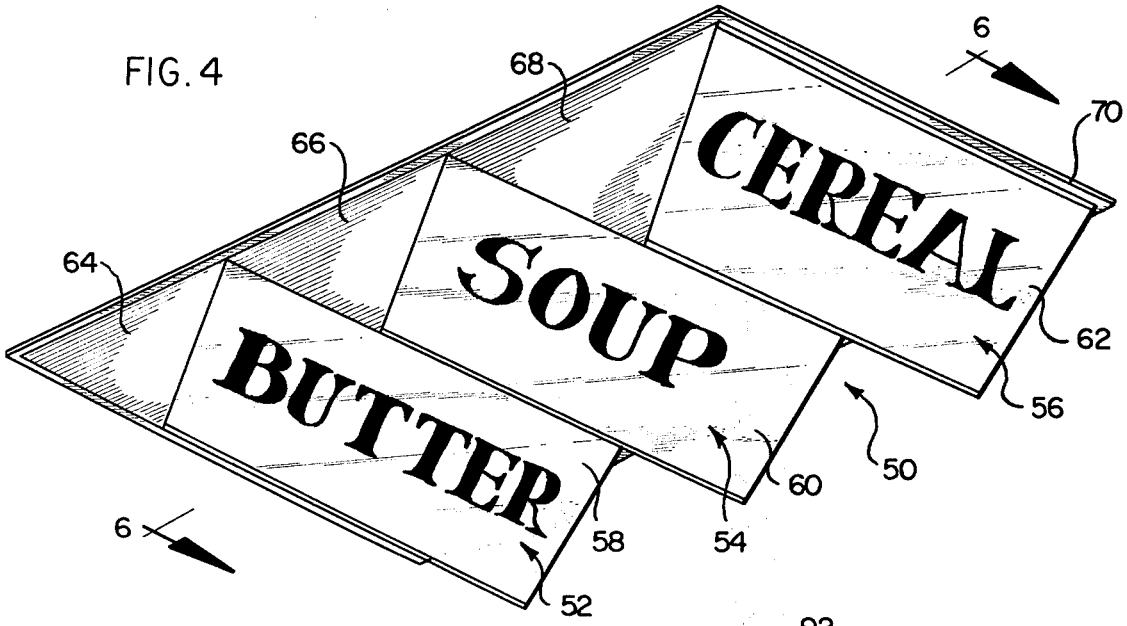
FIG. 4 is a perspective view of a panel module exemplary of another embodiment of the invention.

In FIG. 4, there is illustrated another advertising display panel module 50 which again is proportioned to be coextensive in area to the panel receiving areas defined by the longitudinal and transverse grid members 10 and 12. In this case, however, the advertising display panel module 50 has a peripheral rim 70 which extends horizontally and which is proportioned to seat on the horizontal leg of the T-shaped grid members 10 and 12, and depending from this peripheral rim 70 there are three transversely disposed triangular sections 52, 54 and 56. These triangular sections have walls 58, 60 and 62 which are angularly disposed and provide substantial surfaces for receiving indicia for advertisements or the like which are easily and readily visibly observed when the advertising display panel module 50 is viewed in one direction. Correspondingly, similar walls or surfaces are readily visible when the advertising display panel module 50 is viewed in the opposite direction. Each of the triangular sections 52, 54 and 56 likewise have end walls such as the end walls 64, 66 and 68, so as to provide a hollow enclosure.

Figure 5:
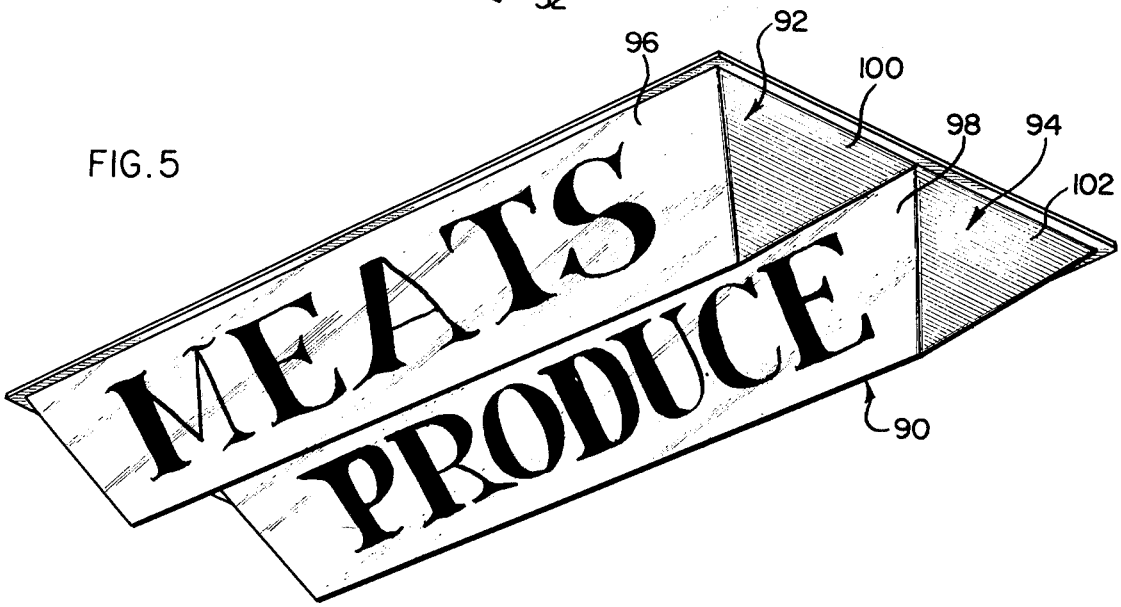
FIG. 5 is a perspective view of a panel module exemplary of still another embodiment of the invention.

In FIG. 5, there is illustrated still another advertising display panel module 90 having a base or peripheral rim 104 which again is proportioned such that it is co-extensive in area with the panel receiving areas and which seats on the horizontal leg of the T-shaped longitudinal and transverse grid members 10 and 12 to support the advertising display module in a depending position from the suspended ceiling. In this case, the advertising display module 90 is formed of two longitudinally extending triangular sections 92 and 94 which provide side walls 96 and 98 for receiving indicia such as advertising indicia which can be readily visibly observed when viewing the display module in one direction. The opposite walls of the triangular sections 92 and 94 provide similar surfaces for receiving advertising indicia which can be readily observed when the advertising module is viewed in the opposite direction. Each of the triangular sections 92 and 94 likewise have end walls such as the end walls 100 and 102 to form a hollow enclosure.

While three specific shapes of the advertising display panel modules have been illustrated, obviously the modules can assume any one of a number of various other shapes and constructions. Accordingly, the modules can be of any construction providing a plurality of walls or surface areas which depend a substantial distance below the surface of the suspended ceiling and upon which indicia can be provided so that the indicia can be easily and readily visibly observed by anyone viewing it. Also, the indicia provided on the modules can include or comprise directional or informational material, or pictorial illustrations of various products or the like. Accordingly, indicia of any nature can be provided on the surfaces of the display modules. More particularly still, while it is anticipated that the display modules will find substantial application in advertising, modules formed of appropriate material and shapes can be utilized to provide a very ornate or decorative suspended ceiling.

Figure 6:
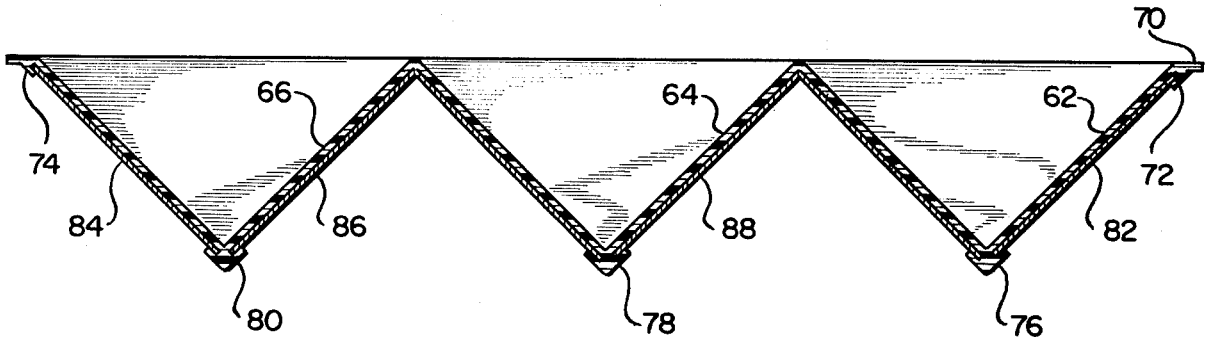
FIG. 6 is a sectional view taken along line 6—6 of FIG. 4.

The indicia can be printed or otherwise directly applied to the surfaces of the modules or, alternatively, the indicia can be provided on cards or inserts which are removably affixed to the modules. For example, in FIG. 6, the module 50 is illustrated having inserts 82, 84, 86 and 88 removably affixed to it. In this case, the module 50 has a spaced flange or clip 72 and 74 integrally or otherwise formed or affixed to it adjacent the peripheral rim 70, and a generally V-shaped flange or clip 76, 78 and 80 integrally or otherwise formed or affixed to it at the apexes of each of the triangular sections. These flanges or clips receive the edges of the inserts behind them and receive the inserts to the walls of the module. It may be noted that the inserts 86 and 88 can be of a one-piece construction and folded V-shape, if desired. The inserts obviously likewise could be secured to the module in any one of a number of different fashions other than by the use of the flanges or clips. For example, the inserts could be removably affixed to the module by means of pin connectors, clips or other such fastening or securing devices. As indicated above, the modules are proportioned to be co-extensive in area to the panel receiving areas in which the ceiling panels 14 normally are removably disposed and supported by the longitudinal and transverse grids 10 and 12 forming the suspended ceiling. Accordingly, any one or more of the modules can be substituted for the ceiling panels 14 simply by removing the ceiling panel and inserting one of the modules. Insertion of the modules is easily and quickly accomplished simply by extending the module between the longitudinal and transverse grid members 10 and 12 and then lowering the module so that the peripheral rim thereof seats on the horizontal leg of the T-shaped longitudinal and transverse grid members 10 and 12. Since the modules depend or are suspended a substantial distance below the surface of the suspended ceiling, the walls upon which the advertising indicia are provided can be easily observed by a viewer.

The modules also may be used in combination or conjunction with the lighting fixtures normally provided in a suspended ceiling or, alternatively, the modules may be provided with lighting means which can be coupled to a source of electrical energy once the module is installed in the suspended ceiling. In many cases, the lighting fixture utilized in combination with a suspended ceiling is supported by the longitudinal and transverse grid members 10 and 12, and has a translucent panel supported by the grid members for concealing the lighting fixture and for diffusing the light emitted by it. In those cases where applicable, the translucent panel can simply be removed, and a module substituted for it, with the module being supported and suspended from the longitudinal and transverse grid members 10 and 12, in the manner described above.

Figure 7:
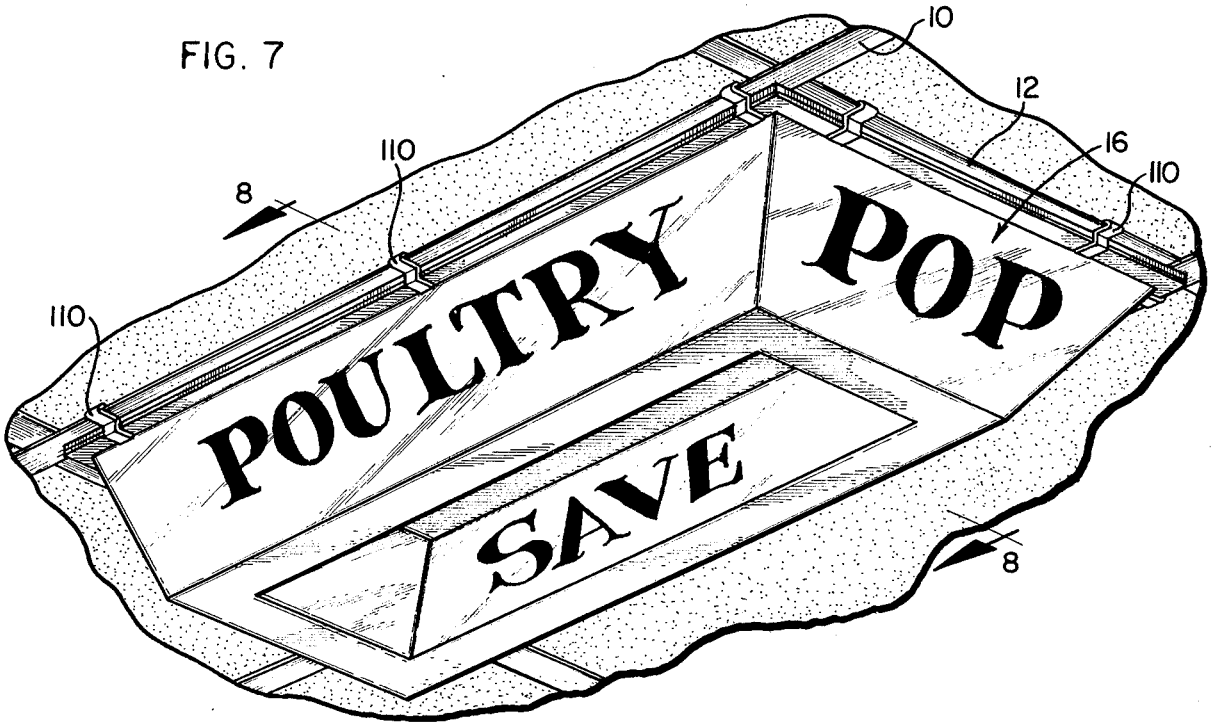
FIG. 7 is a partial isometric view of a ceiling panel generally illustrating the manner in which the panel module of FIG. 1 can be utilized with the lighting fixture normally provided in the suspended ceiling.

In some instances, the lighting fixtures and the diffusion panels for them are formed as integral units in a fashion such that the diffusion panel cannot be removed. In those instances, as illustrated in FIG. 7, the panel may be supported by fastening means such as the retaining clips 110 which are secured to the longitudinal and transverse grid members 10 and 12 and support the module.

Figure 8:
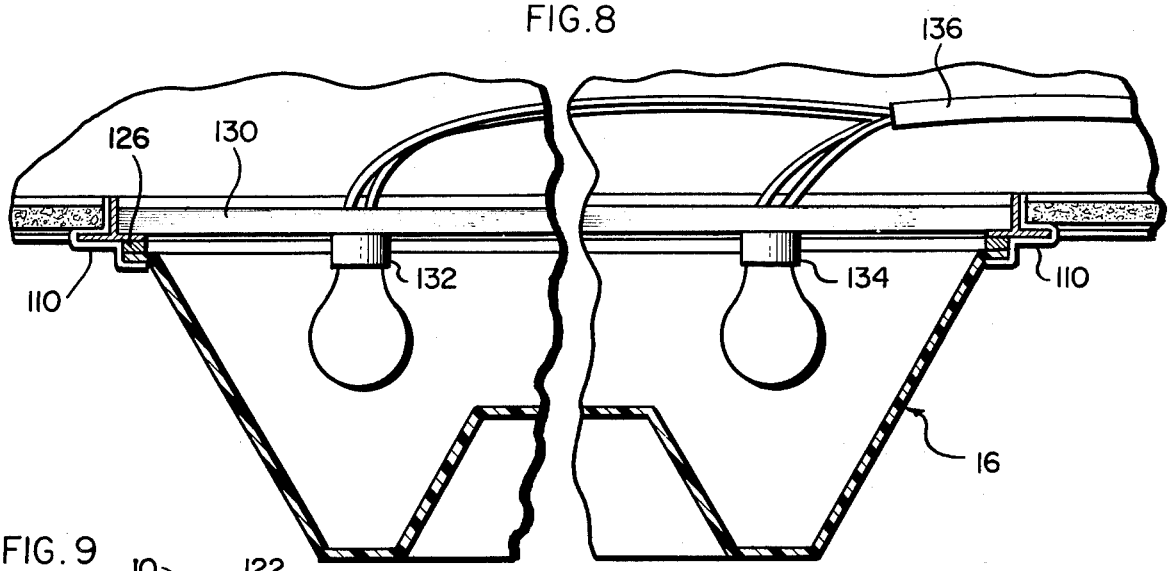
FIG. 8 is a sectional view taken along lines 8—8 of FIG. 7.
Figure 9:
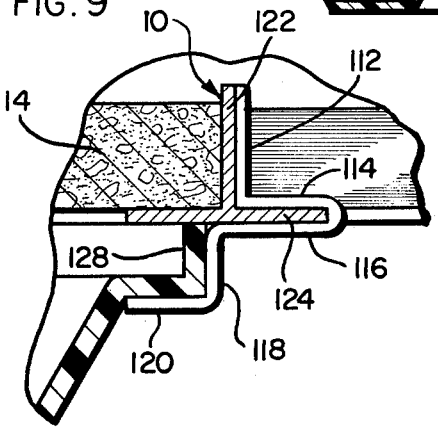
FIG. 9 is an enlarged partial side view generally illustrating the manner in which the panel module is supported by grid members and a clip.
Figure 10:
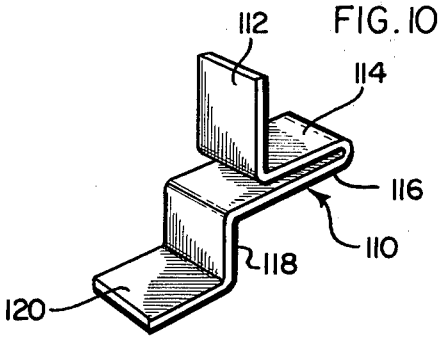
FIG. 10 is a perspective view of the clip utilized with the panel module.

The clips 110, as can be best seen in FIGS. 8–10, comprise a U-shaped section formed of two horizontal leg portions 114 and 116 which are spaced apart and proportioned to receive the horizontally extending portion leg 124 of the T-shaped grip members 10 and 12 snugly between them. The clips 110 also have a vertical leg 112 which abuts against the vertically extending leg 122 of the T-shaped grid members 10 and 12 when the horizontally extending leg portion 124 thereof is received or disposed between the legs 114 and 116 of the clips. The leg 116 of the clips 110 extends horizontally and is of a length such that the vertical leg 118 thereof substantially corresponds to and constitutes an extension of the upright leg 122 of the T-shaped grid members 110 and 112, as can be best seen in FIG. 9. The horizontally extending leg 120 of the clips 110 form a shoulder or flange for supporting thereon the peripheral rim of the modules.

In affixing the clips 110 to the grid members 10 and 12, the ceiling panels 14 surrounding the panel receiving area in which the module is to be affixed are raised so that the clips 110 can be removably affixed to the grip members 10 and 12 with the horizontal leg portion 124 thereof disposed between the legs 114 and 116 of the clips and with the leg 112 abutted against the upright leg 122 thereof. When the clips 110 are affixed to the grid members 10 and 12, the adjoining panels are dropped back into position and the edges of the ceiling panels abut against the legs 112 of the clips to hold the clips in position, with the legs 112 being disposed between the upright legs 122 and the edges of the ceiling panels, as can be best seen in FIG. 9. Once the clips 110 are affixed to the grid members 10 and 12, the modules are secured in suspended position by seating the peripheral rims thereof on the legs 120 of the clips 110, as illustrated in FIGS. 8 and 9. A resilient spacer 126 can be disposed between the peripheral rims of the modules and the horizontal leg of the T-shaped grid members 10 and 12 to provide a tighter fit if desired. Alternatively, an upstanding flange 128 can be provided about the periphery of the rim of the modules, which flange abuts against the horizontal leg of the T-shaped grid members 10 and 12 to function in substantially the same manner as the resilient spacer 126, as illustrated in FIG. 9.

As indicated above, the modules can be provided with lighting fixtures, such as the lighting fixtures 132 and 134, if desired, so that a lighted module can be provided in those locations where the suspended ceiling does not contain its own lighting fixture. In such cases, one or more fixture support brackets such as the fixture support bracket 130 which spans between the longitudinal or transverse grids and supports the lighting fixtures 132 and 134 are simply placed in position prior to affixing the modules in position. The lighting fixtures then are simply coupled to a source of electrical energy by means of wiring such as the wiring 136 to energize the lighting fixtures 132 and 134.

Now that the invention has been described, what is claimed as new and desired to be secured by Letters Patent is :

1. An advertising display module for use with suspended ceilings having spaced-apart grid members defining panel receiving areas, ceiling panels removably supported by said grid members in said panel receiving areas and lighting fixtures disposed in cooperative working relationship with pre-determined ones of said ceiling panels, said advertising display module being co-extensive in area with the respective ones of said panel receiving areas and supported by said grid members defining the respective ones of said panel receiving areas, whereby one or more of said advertising display modules can be removably disposed in conjunction with or in substitution for any one of said ceiling panels to provide readily visible advertising, said advertising display module comprising a hollow enclosure formed by a plurality of walls, at least some of which depend downward with respect to said suspending ceiling and provide surfaces for receiving thereon indicia, and indicia on at least one of said surfaces, and securement means comprising a clip removably secured to said grid member and having a shoulder forming a support surface upon which said peripheral rim seats to support said module from said grid members.

2. The advertising display module of claim 1, wherein said securement means comprises a clip removably secured to said grid member and having one leg retained between a leg of said grid member and an edge of a panel, whereby said clip is secured in place, and a horizontal leg forming a shoulder upon which said peripheral rim seats to support said module from said grid member.

3. A clip for use in combination with a suspended ceiling having spaced-apart T-shaped grid members defining panel receiving areas and ceiling panels removably supported by said grid members to support an advertising display module suspended below said suspended ceiling, said clip having one leg which extends vertically and is retained between a leg of said T-shaped grid member and an edge of a panel, whereby said clip is secured in place, and a horizontal leg forming a shoulder upon which the peripheral edge of said module seats to support said module from said grid members.

4. The clip of claim 3, further comprising a pair of spaced-apart horizontally extending legs for receiving therebetween a horizontal leg portion of said T-shaped grid members, for securing said clip to said grid member.

* * * * *